US005110100A

United States Patent [19]

Cotton

[11] Patent Number: 5,110,100

[45] Date of Patent: May 5, 1992

[54] ELECTRIC VISE

[75] Inventor: Lawrence M. Cotton, New Bern, N.C.

[73] Assignee: Robert Bosch Power Tool Corporation, New Bern, N.C.

[21] Appl. No.: 619,308

[22] Filed: Nov. 28, 1990

[51] Int. Cl.[5] ..... B25B 1/10

[52] U.S. Cl. ..... 269/244; 269/283; 269/253

[58] Field of Search ..... 269/271, 279-284, 269/244, 246, 240, 329, 32, 23

[56] References Cited

U.S. PATENT DOCUMENTS 4,046,364 9/1977 Coope et al. ..... 269/244

4,078,782 3/1978 Carlson ..... 269/283

*Primary Examiner*—Robert C. Watson

*Attorney, Agent, or Firm*—Michael J. Striker

[57] ABSTRACT

A vise comprises two jaws formed so that at least one of the jaws is movable relative to the other of the jaws, a rotary drive pivotally connected with at least the one movable jaw so as to move the one jaw relative to the other jaw, and a one-way slip clutch located between the drive and the movable jaw so that a drive force is positively transmittted to the one jaw so as to positively move the one jaw away of the other jaw, and at the same time during movement of the one jaw toward the other jaw the clutch slips over so as to prevent excessive application of clamping force by the movable jaw on an object to be clamped.

11 Claims, 4 Drawing Sheets 1
2
21
22
23
24
25
26
27
28
29

ELECTRIC VISE

BACKGROUND OF THE INVENTION

The present invention relates generally to vises for clamping various objects.

Vises are widely known and used in modern industry. A known vise has two jaws, of which at least one jaw is movable relative to the other so as to clamp and object. Some of such vises are disclosed in U.S. Pat. Nos. 3,779,538, 3,650,522, 3,400,924, 4,046,364, 4,770,401. The same vise is frequently used for clamping of objects having different properties, or more particularly sensitive to application of a clamping force in a different manner. It is therefore advisable to provide such a vise in which a clamping force can be adapted to the property of an object to be clamped.

SUMMARY OF THE INVENTION

Accordingly, it is an object of the present invention to provide a vise which is a further improvement over existing vises and advantageous in some aspects as compared with them.

More particularly, it is an object of the present invention to provide a vise which can be easily adapted to an object to be clamped, in the sense of selection of a clamping force.

In keeping with these objects and with others which will become apparent hereinafter, one feature of the present invention resides, briefly stated, in a vise which has two jaw elements with at least one jaw element movable relative to the other jaw element, a drive, and a one-way clutch located between the drive and the movable jaw element so that the movable jaw can be displaced by the drive away of the other jaw with a positive transmission of the drive force, and at the same time during movement of the movable jaw toward the other jaw for clamping an object the clutch slips over so as to prevent application of an excessive clamping force to the object.

In accordance with another feature of the present invention, the slippage of the clutch can be adjusted so as to adjust the clamping force applied by the movable jaw to the object.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
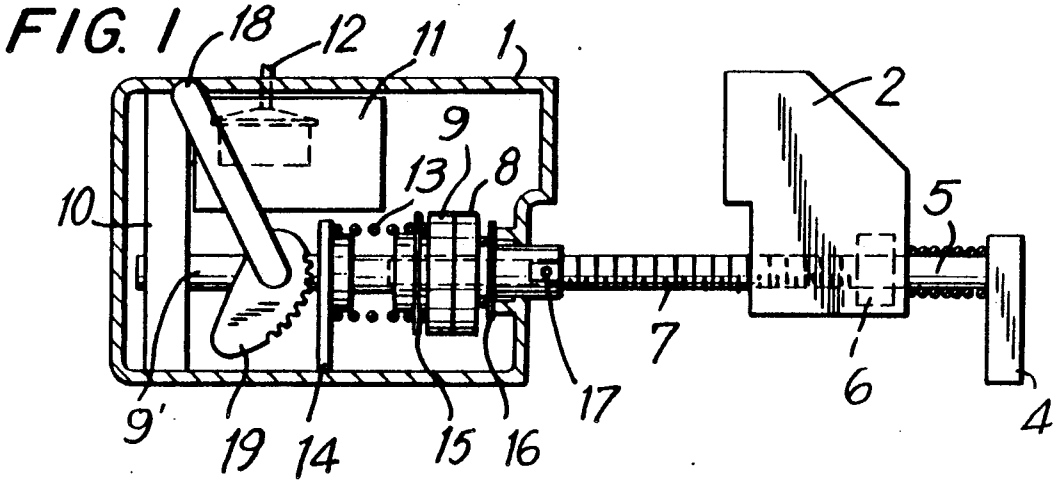
FIG. 1 is a side view of a vise in accordance with the present invention.

A vise shown in FIG. 1 has two jaws identified with reference numerals 1 and 2. The jaw 1 is immovable and formed as a housing, while the jaw 2 is movable. The movable jaw 2 has guiding openings and is guided on guiding tubes 3 connected with an end piece 4. Springs 5 are arranged on the guiding tubes between the movable jaw and the end piece 4 so as to keep a nut 6 arranged in the movable jaw 2 in contact with a threaded rod 7 after the nut 6 is disengaged from the threaded rod 7. The threaded rod 7 extends into the interior of the movable jaw 1 and is connected with one half 8 of a clutch. Another half 9 of the clutch is mounted on a shaft 9 of a gear box 10 which in turn is connected with a motor 11 provided with a switch 12. A spring 13 spring-biases the clutch half 9 toward the clutch half 8 and abuts with its opposite end against a clutch pusher 14 which is movable on the shaft 9. The clutch is provided with thrust washers 15 and thrust bearings 16. A pin 17 connects the clutch half 8 with the threaded rod 7. A lever 18 is provided with a cam 19 which is turnable by a lever to displace the clutch pusher 14. The motor 12 is operative for rotating in opposite directions.

Figure 3A:
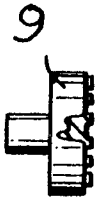
FIGS. 3A and 3B are views showing a one-way slip clutch of the inventive vise.
Figure 3B:
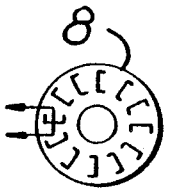

As can be seen from FIG. 3, the clutch 8, 9 is formed as a one-way slip clutch. It can be made for example by providing ramp-like projections on the clutch half, inclined in one circumferential direction.

The vise in accordance with the present invention operates in the following manner. When the switch 12 is activated by a user, the motor is energized and the shaft 9 is rotated in one direction through the transmission 10. With the clutch pusher activated so as to press the clutch half 9 against the clutch half 8, the rotation of the drive shaft 9 is transmitted to the threaded rod 7 and the movable jaw 2 is moved toward the movable jaw 1, so as to clamp an object between the jaws. When the movable jaw 2 abuts against the object so that it is initially clamped between the jaws, the clutch slips over, and no excessive force can be applied by the movable jaw against the object. When the user continues to push the switch, a very small value of the clamping force is added, with slippage of the clutch after each force application. For releasing the object the switch is moved to the position to activate the rotation of the motor in the opposite direction, and the rotation of the motor is transmitted through the transmission 10, the shaft 9 and the threaded rod 7 to the movable jaw in a positive manner, so that the movable jaw moves away of the immovable jaw 1.

By turning the lever 18, the cam 19 displaces the clutch pusher 14 and compresses or releases the spring 13 so as to apply more or less pressure to the clutch half 9. As a result, the slippage of the clutch is performed at a higher or a lower force applied by the movable jaw to the object. Thus, the clamping force of the vise can be adjusted in a desirable manner. For harder objects the clamping force can be higher, while for softer objects the clamping force can be lower.

Figure 4:
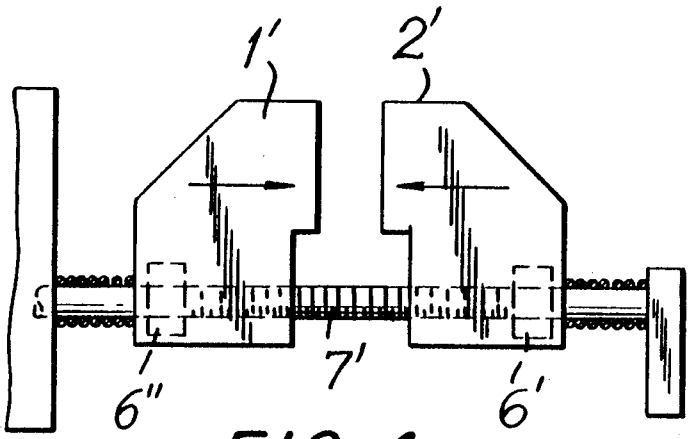
FIG. 4 is a view showing a further modification of the jaws of the inventive vise.
Figure 2:
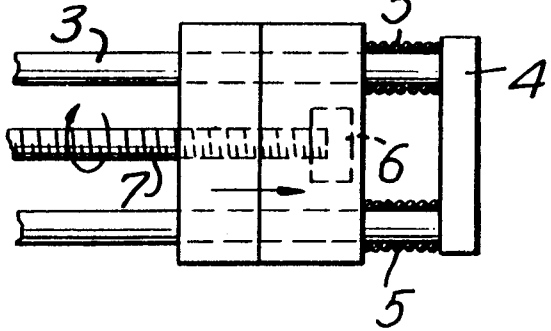
FIG. 2 is a top view of a portion of the inventive vise.
Figure 5:
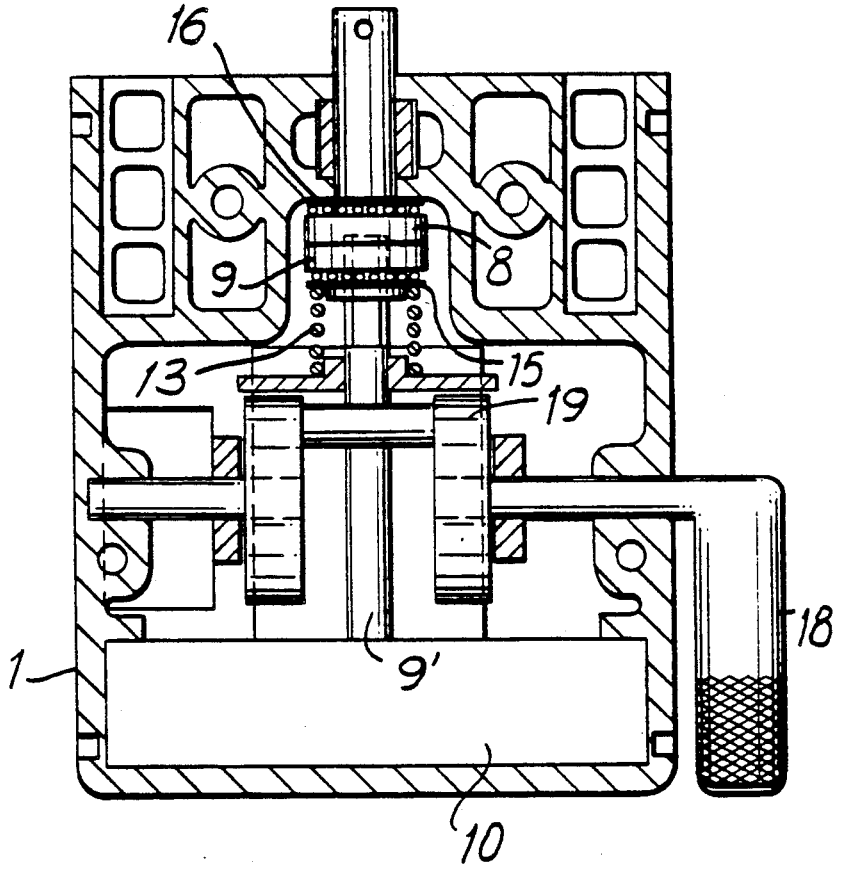
FIG. 5 is a bottom view of a part of the vise in accordance with the present invention.

FIG. 4 shows modification of the vise in which both jaws 1' and 2' are movable and located on a threaded rod 7' provided with a left hand thread and a right hand thread. The nuts 6' and 6'' and therefore the respective jaws move along the threaded rod under the action of turning of the drive shaft.

Figures 6, 7:
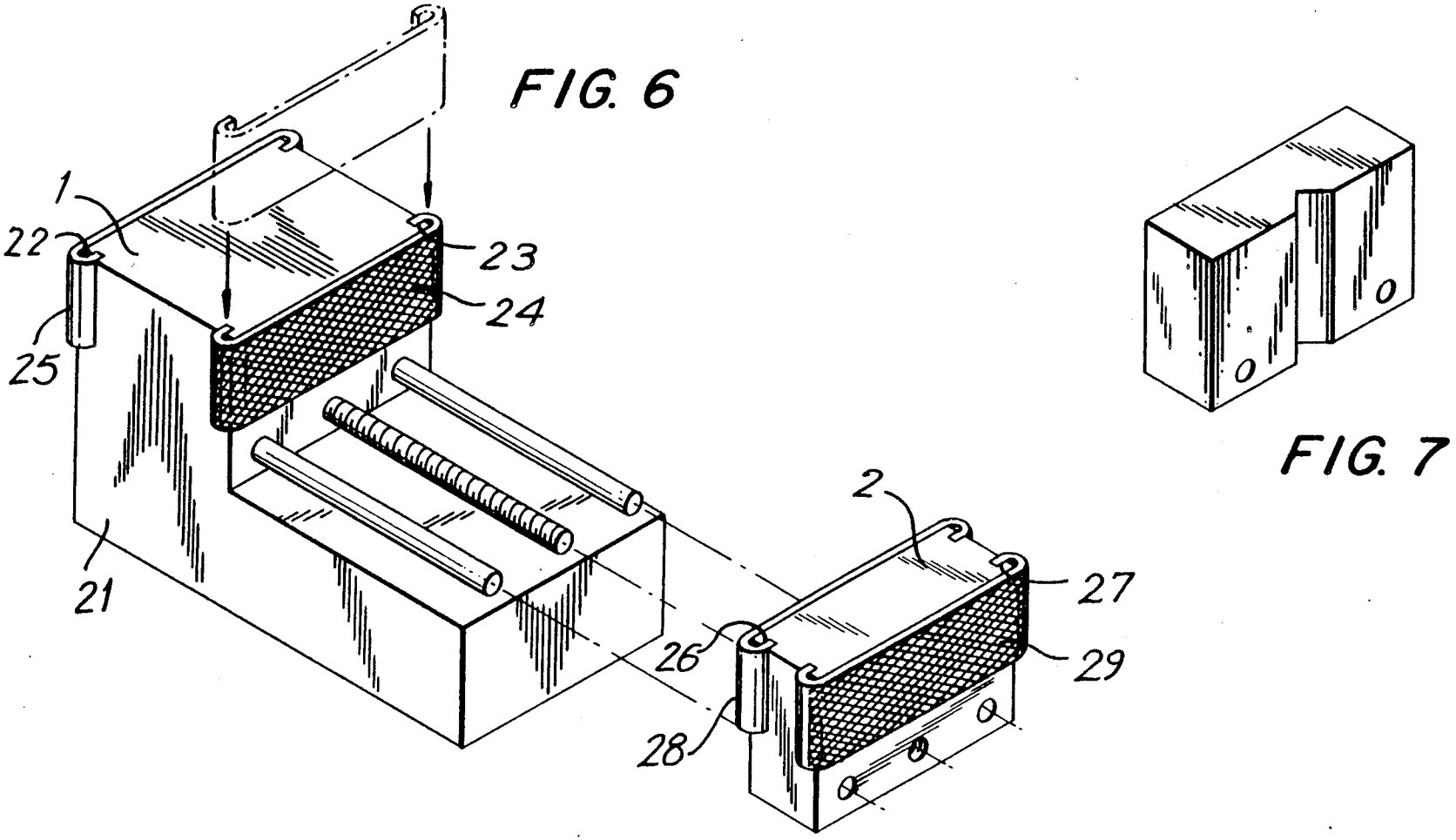
FIG. 6 is a perspective view showing still a further modification of the vise in accordance with the present invention.
FIG. 7 is a view showing a different shape of a jaw of the inventive vise.
Figure 10:
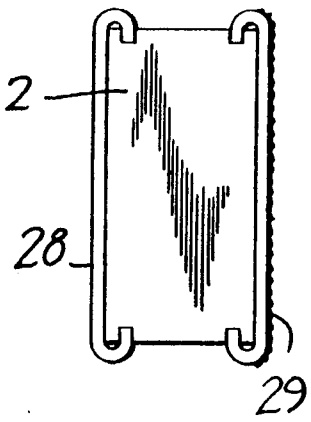
FIG. 10 is a top view of the jaw of FIG. 9.

As can be seen from FIG. 6 the movable jaw 1 can be box-shaped and provided with a vertical portion and a horizontal portion. The movable jaw 2 moves horizontally toward and away of the vertical portion of the movable jaw 1. The vertical portion of the movable jaw 1 is provided with two sets of grooves 22 and 23. The vise has two face parts 24 and 25 having different properties, for example different hardnesses, in order to clamp objects having different properties. The face parts 24 and 25 can be attached to the vertical portion 21 of the movable jaw 1 by sliding of their end sides in the grooves 22 and 23. In the shown embodiment the face part 24 is located in a working position, while the face part 25 is located in a storage position. The movable jaw 2 is also provided with two sets of grooves 26 and 27 which can receive the bent sides of the face parts 28 and 29 having different properties. Face part 28 is in a working condition, while the face part 29 is in a storing position.

Figure 9:
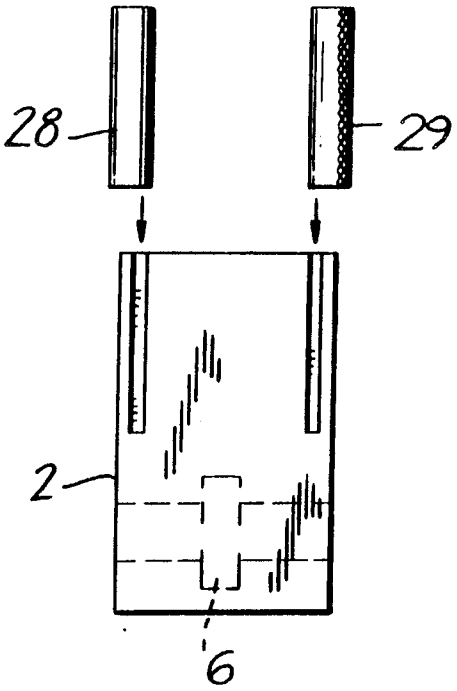
FIG. 9 is a view schematically showing a movable jaw with the exchangeable face parts.
Figure 8:
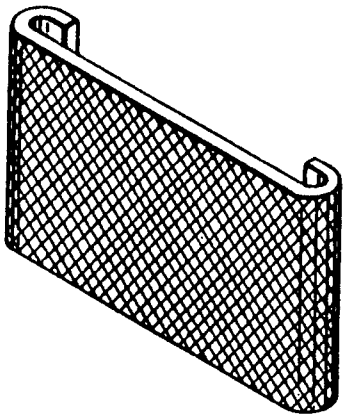
FIG. 8 is a view showing a removable face part of the jaw of the inventive vise.

FIG. 7 shows that one of the jaws can have a V-grooved face for example for holding round objects. FIG. 8 shows that the face part of the jaws can be knurled. FIG. 9 shows a movable jaw 2 in which one face insert 28 is of neoprene, rubber, etc. while the other jaw 29 is formed of knurled steel.

In the inventive vise, due to the one-way slip clutch the slip of the jaws when closing on an object is insured, but it always opens when desired. This is an important safety feature. The above mentioned clutch between the drive shaft and the output shaft provides excellent sensitivity and control of the jaw pressure. The nut which carries the movable jaw is released from the threaded rod at the extreme open position of the jaws. When the jaw begins to close, the nut is immediately and automatically picked up by the threaded rod. The cam which controls the compression spring pressure on the clutch is detented for repeatable, audible adjustment of jaw pressure due to projections provided on the cam surface. With the slipping of the clutch itself, there is no need for limit switches. The electric vise in accordance with the present invention is very compact, simple, and inexpensive to manufacture.

It will be understood that each of the elements described above, or two or more together, may also find a useful application in other types of constructions differing from the types described above.

While the invention has been illustrated and described as embodied in a vise, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claim:

1. A vise, comprising two jaws formed so that at least one of said jaws is movable relative to the other of said jaws; a rotary drive pivotally connected with at least said one movable jaw so as to move said one relative to said other jaw; and a one-way slip clutch having two clutch halves provided with ramp-like projections inclined in one circumferential direction, said clutch being located between said drive and said movable jaw so that a drive force is positively transmitted to said one jaw so as to positively move said one jaw away of said other jaw, and at the same time during movement of said one jaw toward said other jaw said clutch slips over so as to prevent excessive application of clamping force by said movable jaw on an object to be clamped.

2. A vise as defined in claim 1, wherein said drive has a driving shaft carrying one clutch half of said clutch; and further comprising a threaded rod which carries another clutch half of a said clutch cooperating with said one clutch half, said movable jaw having a thread cooperating with a thread of said threaded rod so that during a rotation of said thread rod from said driving shaft through said clutch, said movable jaw moves along said threaded rod toward and away of said immovable jaw.

3. A vise as defined in claim 1; and further comprising spring means including a single spring arranged so as to press said movable jaw toward said thread of said threaded rod after said thread of said movable jaw has been disengaged from said thread of said threaded rod.

4. A vise as defined in claim 2; and further comprising means for adjusting a slippage of said clutch.

5. A vise, comprising two jaws formed so that at least one of said jaws is movable relative to the other of said jaws; a rotary drive pivotally connected with at least said one movable jaw so as to move said one relative to said other jaw; a one-way slip clutch having two clutch halves and located between said drive and said movable jaw so that a drive force is positively transmitted to said one jaw so as to positively move said one jaw away of said other jaw, and at the same time during movement of said one jaw toward said other jaw said clutch slips over so as to prevent excessive application of clamping force by said movable jaw on an object to be clamped; and means for adjusting a slippage of said clutch, said slippage adjusting means including a turnable cam arranged to move one of said clutch halves relative to the other of clutch halves of said clutch.

6. A vise as defined in claim 5, wherein said slippage adjusting means include a lever connected with said cam and arranged to turn said cam.

7. A vise as defined in claim 5, wherein said slippage adjusting means includes a clutch with one clutch half displaceable by said cam and a compression spring located between said clutch pusher and said one clutch half.

8. A vise as defined in claim 1, wherein at least one of said jaws has a main part and at least one replaceable face part exchangeably mountable on said main part.

9. A vise as defined in claim 8, wherein said at least one jaw has another such face part, said face parts being mountable on different portions of said at least one jaw.

10. A vise as defined in claim 9, wherein said face parts have different properties so as to be used for clamping of different objects.

11. A vise, comprising two jaws formed so that at least one of said jaws is movable relative to the other of said jaws; a rotary drive pivotally connected with at least said one movable jaw so as to move said one relative to said other jaw; and a one-way slip clutch located between said drive and said movable jaw so that a drive force is positively transmitted to said one jaw so as to positively move said one jaw away of said other jaw, and at the same time during movement of said one jaw toward said other jaw said clutch slips over so as to prevent excessive application of clamping force by said movable jaw on an object to be clamped, at least one of said jaws having main part and at least one replaceable face part exchangeably mountable on said main part in a working position and in a storage position.

* * * * *